US006949890B2

(12) United States Patent
Chou et al.

(10) Patent No.: US 6,949,890 B2
(45) Date of Patent: Sep. 27, 2005

(54) LCD BACK LIGHT PANEL LAMP CONNECTING STRUCTURE

(75) Inventors: Chin-Wen Chou, Hsin-Tien (TW); Eddie Cheng, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/359,182

(22) Filed: Feb. 6, 2003

(65) Prior Publication Data

US 2004/0155601 A1 Aug. 12, 2004

(51) Int. Cl.[7] ..... H05B 37/02; H05B 37/00; G09F 13/04

(52) U.S. Cl. ..... 315/294; 315/276; 315/312; 315/DIG. 5; 362/29

(58) Field of Search ..... 315/291, 294, 315/296, 307, 312, 209 PZ, 324, 276, DIG. 4, DIG. 5, 277, 209 R, 219; 362/29, 97, 224; 349/70, 50; H05B 37/02, 37/00; G09F 13/04

(56) References Cited

U.S. PATENT DOCUMENTS 5,998,936 A * 12/1999 Nilssen ..... 315/209 R
6,278,226 B1 * 8/2001 Danov et al. ..... 310/359
6,534,934 B1 * 3/2003 Lin et al. ..... 315/312
6,570,344 B2 * 5/2003 Lin ..... 315/224
2003/0035283 A1 * 2/2003 Lim ..... 362/97
2003/0178951 A1 * 9/2003 Park et al. ..... 315/312
2004/0119418 A1 * 6/2004 Moon ..... 315/169.3

FOREIGN PATENT DOCUMENTS

JP 109193423 A * 7/1997 ..... B41J/2/32
JP 2000-338487 A * 12/2000 ..... G02F/1/13357

* cited by examiner

*Primary Examiner*—Trinh Vo Dinh
(74) *Attorney, Agent, or Firm*—Birch, Stewart, Kolasch & Birch, LLP

(57) ABSTRACT

An improved LCD back light panel lamp connecting structure comprises at least one set of cold cathode fluorescent lamps (CCFL), each having its high voltage end and feedback end arranged alternately, and the feedback ends on both sides of the CCFL respectively coupled to two return boards. Such two return boards are coupled to a pulse width modulation (PWM) control unit, so that the two return boards feed back the current to the PWM control unit. The high voltage end of the CCFL is coupled to a transformer.

3 Claims, 5 Drawing Sheets

LCD BACK LIGHT PANEL LAMP CONNECTING STRUCTURE

FIELD OF INVENTION

The present invention relates to an improved LCD back light panel lamp connecting structure, more particularly to a plurality of cold cathode fluorescent lamps (CCFL), each having its high voltage end and feedback end arranged alternately.

BACKGROUND OF THE INVENTION

A traditional LCD TV or touch screen of a LCD display requires a high brightness to compensate the visual requirements. In general, a cold cathode fluorescent lamp (CCFL) is lit by high voltage; the larger the current, the brighter is the lamp. Therefore several CCFL lamps are generally used to compensate the brightness and evenness, and it is the most important issue is to keep the current of the lamp even and minimize the error. The installation of several sets of loading also increases the number of control units for the lighting and the area of the circuit board, and thus making the manufacturing more complicated and the cost higher. In FIG. 1, it shows a driving device that lights up a CCFL, and comprises a power supply unit 13, a pulse width modulation (PWM) control unit 14, a driving unit 15, a transformer 11, and a loaded cold cathode florescent lamp (FFCL) 12. When the input of the input voltage is initialized, the driving unit 15 immediately drives the transformer 11 to light up the CCFL 12 by the negative/positive voltage effect and the PWM control 14 detects the current of the CCFL lamp 12 through the current feedback 16 and outputs a resonant frequency. The average current of the CCFL lamp 12 can be controlled by means of the driving unit 15 and the transformer 11. Therefore, the light produced can be projected onto the back light panel of the LCD.

Please refer to FIG. 2 for the schematic circuit diagram of a plurality of lamps in accordance with a prior art. In the figure, the high voltage ends 22 of a plurality of lamps 21 respectively connect to a connector 221 and a connector 231 of a transformer 23, and said plurality of transformers 23 are integrated to a circuit board 26 to form an inverter 20, and the feedback end 24 of the plurality of lamps 21 are mutually coupled and connected to the PWM control unit 25, so that the PWM control unit 25 can detect the current of the lamp 21 through the current feedback to output a resonant frequency and control the average current of the CCFL lamp 12.

However, the connection method of the CCFL lamps described above has the following shortcomings:

1. Firstly, the feedback end of the prior-art multiple lamps generally makes the wiring job more complicated, not only increasing the size of the circuit board, but also making the manufacturing complicated, increasing the cost, and unnecessarily consuming higher voltage.
2. Secondly, since the high voltage ends of the cold cathode fluorescent lamps are installed on the same side of the lamp, therefore when the lamp is lit, the temperature at that side is usually too high and thus affecting the life of the lamp.
3. Thirdly, when several lamps are used to compensate the brightness and evenness, it generally causes uneven current and brightness between the lamps since there generally exists a discrepancy between lamps for their production. Thus, it becomes an issue of selecting lamps, or it may require more lamps to improve the brightness and evenness. Such arrangement will increase the cost, and make the manufacture more complicated and the adjustment more difficult.

SUMMARY OF THE INVENTION

The primary objective of the present invention is to overcome the shortcomings and avoid the deficiencies of the prior art. The present invention alternately arranges the high voltage end and the feedback end of at least one set of cold cathode fluorescent lamps to save wire materials, average the current of the lamp, and enhance the stability of the current.

To achieve the above objective, the improved LCD back light panel lamp connection structure of the present invention comprises at least one set of cold cathode fluorescent lamps (CCFL), each having its high voltage end and feedback end arranged alternately, and the feedback ends on both sides of the CCFL respectively coupled to two return boards. Such two return boards are coupled to a pulse width modulation (PWM) control unit, so that the two return boards feed back the current to the PWM control unit. The high voltage end of the CCFL respectively couples to a transformer and drives the transformer to light up several sets of cold cathode fluorescent lamps, and the feedback end of the plurality of CCFLs feeds back the current through the two return boards to a PWM control unit. Such PWM control unit detects the current of the lamp to output a resonant frequency and control the average current of the several sets of CCFLs.

DETAILED DESCRIPTION OF THE PREFERRED EMBODIMENTS

Figure 1:
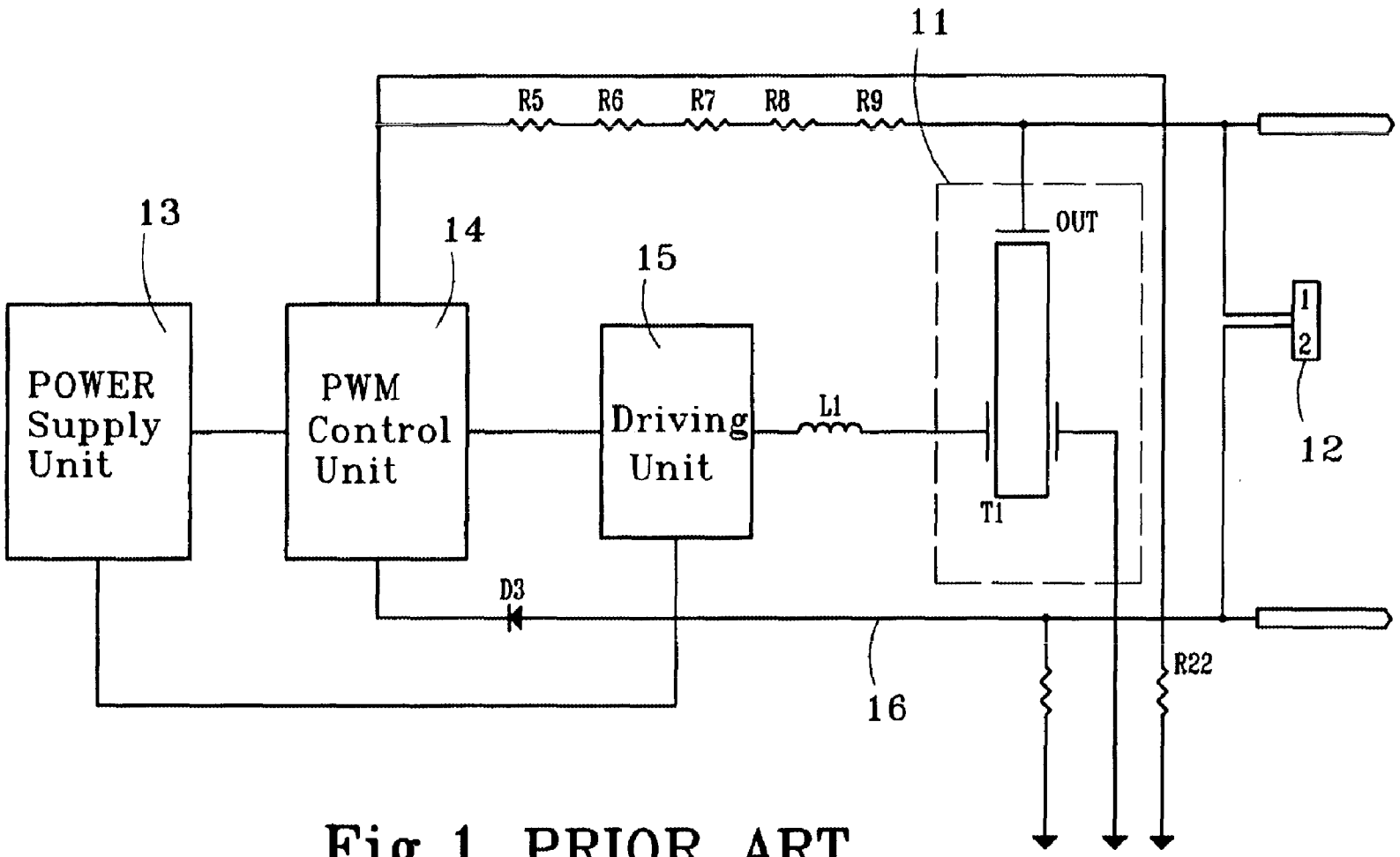
Fig.1 PRIOR ART
FIG. 1 is a schematic circuit diagram of a prior-art cold cathode fluorescent lamp.
Figure 2:
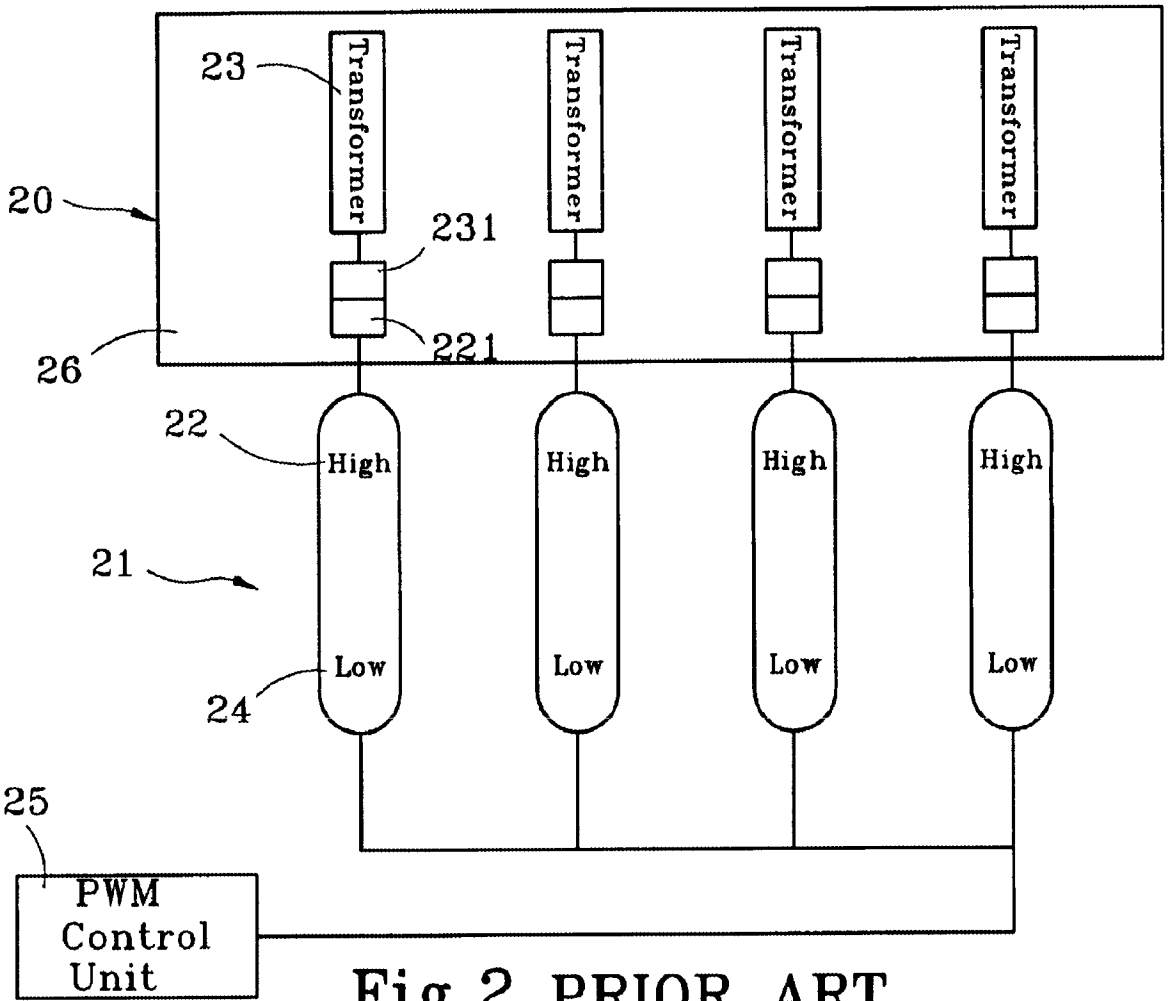
Fig.2 PRIOR ART
FIG. 2 is schematic circuit diagram of a multiple of prior-art lamps.
Figure 3:
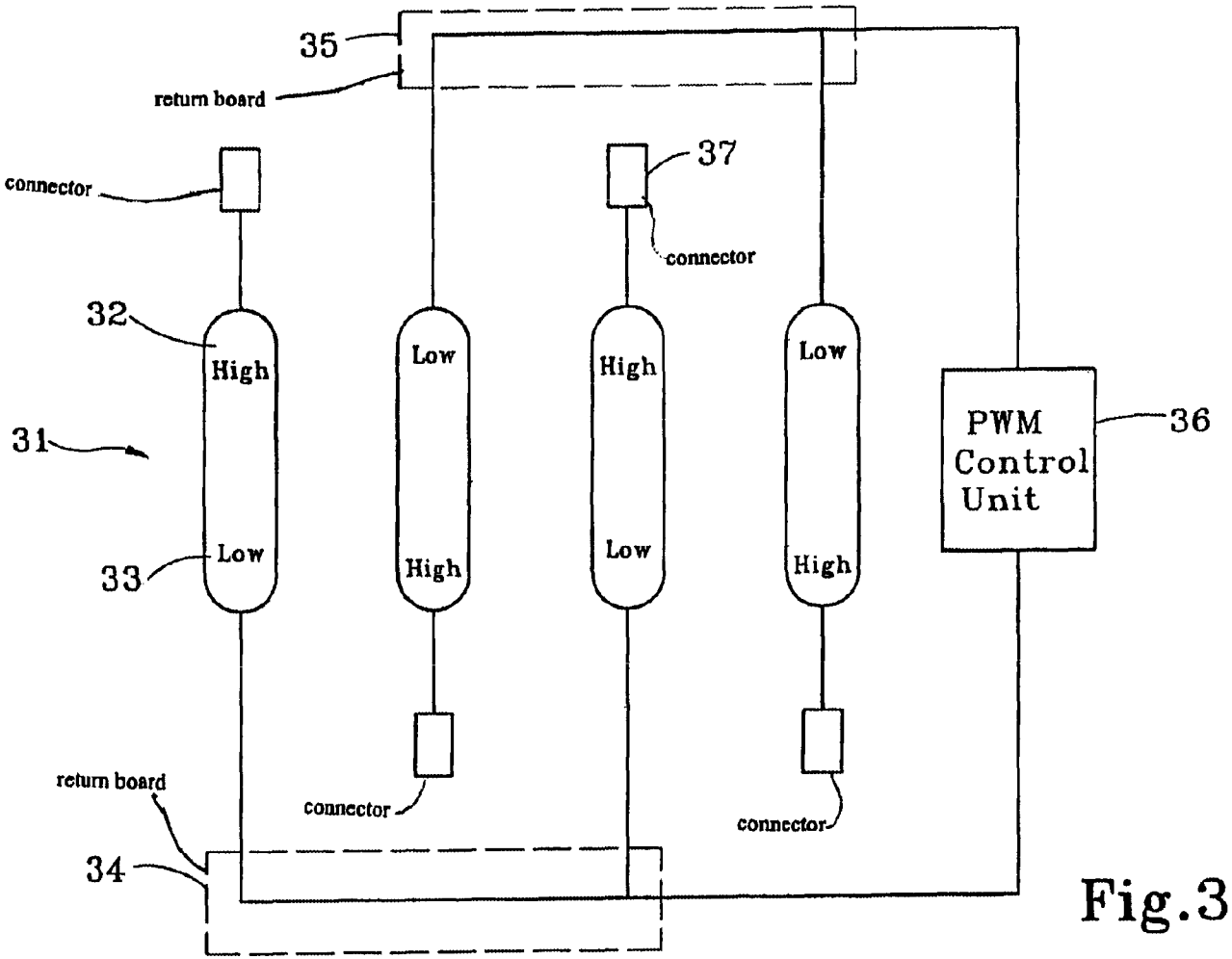
FIG. 3 is a block diagram of the circuit of the present invention.
Figure 4:
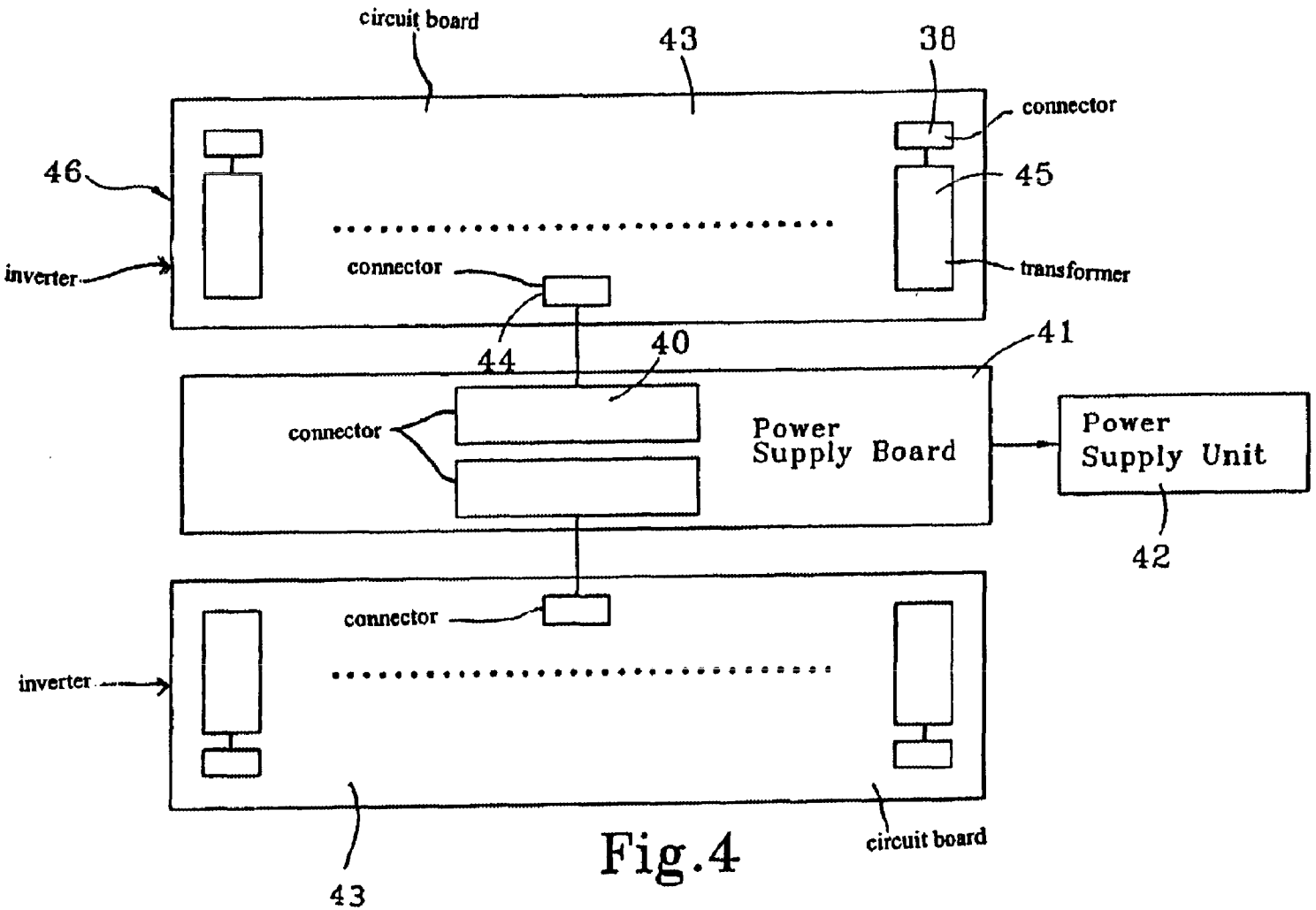
FIG. 4 is a schematic diagram of the transformer and power supply board of the present invention.

Please refer to FIGS. 3 and 4 for the block diagram of the circuit and the schematic diagram of the transformer and power supply board of the present invention respectively. In the figures, the improved LCD back light panel lamp connecting structure comprises at least one set of cold cathode fluorescent lamps (CCFL) 31, each having its high voltage end 32 and feedback end 33 arranged alternately, and the feedback ends 33 on both sides of the CCFL 31 respectively coupled to two return boards 34, 35. Such two return boards 34, 35 are coupled to a pulse width modulation (PWM) control unit 36, so that the two return boards 34, 35 feed back the current to the PWM control unit 36; the high voltage end 32 of the CCFL 31 couples to a connector 38 at an output end of a transformer 45 by a connector 37; the feedback ends 33 of the CCFL 31 mutually couples to the two return boards 34, 35; said transformer comprises at least one transformer or ceramic transformer being coupled to the connector 37 of the CCFL 31 by a connector 38, and each transformer 45 is integrated on a circuit board 43 to form a inverter 46, and then connected to a connector 40 on a power supply board 41 by a connector 44 on the circuit board 43. The power supply board 41 is coupled to a power supply unit

42 so that the power can be supplies to each transformer 45 on the inverter 46 via the power supply board 41, which can save wire materials and simplify the structure.

Figure 5:
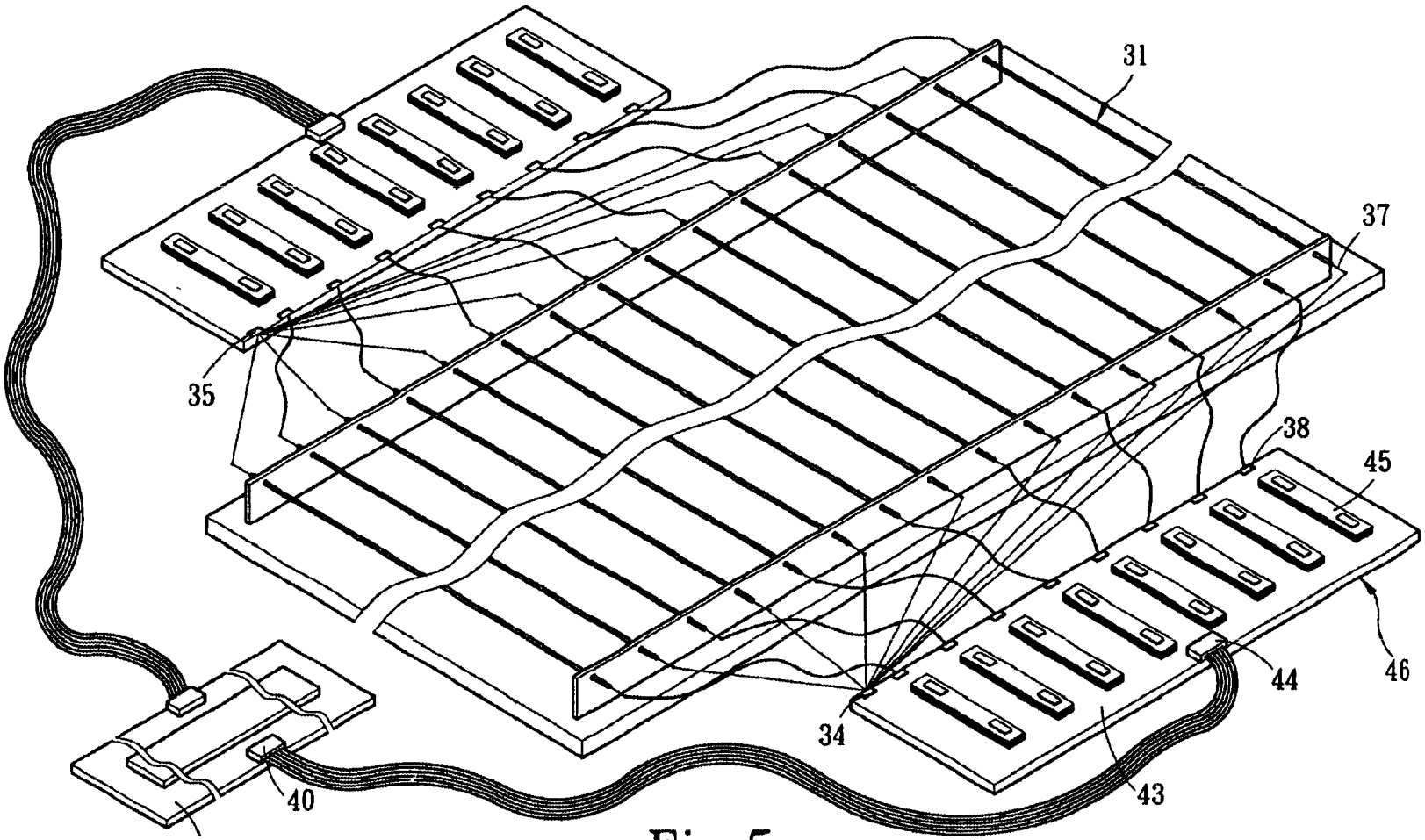
FIG. 5 is a diagram of the layout of the present invention.

FIG. 5 shows the physical arrangement of the parts of the present invention. Accordingly, the figure shows the connection structure of the lamps and the return boards.

Two or four cold cathode fluorescent lamps could be used as the CCFL 31 in this preferred embodiment, so that the transformer 45 is driven to light up several sets of the CCFLs 31, and the feed back end 33 of each CCFL 31 feeds back the current to the PWM control unit 36 through the two return boards 34, 35, and the PWM control unit 36 detects the current of the CCFL 31 to output a resonant frequency, and control the average current of several sets of the CCFLs 31.

In view of the description above, the present invention definitely overcomes the shortcomings of the prior art and has the following advantages:

1. The present invention arranges the CCFLs alternately, such that the high voltage ends of the lamps are arranged alternately, and thus will not overheat one side of the lamp when the lamp is lit.
2. The feedback ends of several lamps of the present invention are connected in series, and all coupled to the two return boards, not only saving wire material, lowering the consumption of voltage for transmission, and increasing the stability of the circuit, but also making the manufacture easy and the cost lower.
3. The present invention arranges the high voltage end and the feedback end of several lamps alternately, so that the current of each CCFL can be more evenly distributed, and thus achieving the purpose of even lighting.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An LCD back light panel lamp connection structure comprising;

a plurality of cold cathode fluorescent lamps, each of said lamps having a high voltage end at a first voltage and a feedback end at a second voltage;

said lamps arranged in parallel in a first direction forming a row in a second direction perpendicular to said first direction;

adjacent lamps in said row alternately reversing high voltage ends and feedback ends so that ends of said lamps on each side of said row alternate between high voltage ends and feedback ends; and return boards provided on opposite sides of said row, each return board being connected to a half of said feedback ends of said lamps which are closer to the return board than the other half of said feedback ends.

2. The improved LCD back light panel lamp connection structure of claim 1, wherein light from said lamps is evenly distributed between both sides of said connection structure.

3. The LCD back light panel lamp connection structure of claim 1, wherein heat is distributed evenly between both sides of said connection structure.

* * * * *